US009170077B2

(12) United States Patent
Johnson et al.

(10) Patent No.: US 9,170,077 B2
(45) Date of Patent: Oct. 27, 2015

(54) SHOOTING TARGET WITH REACTIVE ZONES

(71) Applicant: Birchwood Casey, LLC, Eden Prairie, MN (US)

(72) Inventors: Scott Benjamin Johnson, Minneapolis, MN (US); Todd Binsfeld, Inver Grove Heights, MN (US); Nathan Northup, Rosemount, MN (US); Jamie William Brandt, Forest Lake, MN (US)

(73) Assignee: Birchwood Casey, LLC, Eden Prairie, MN (US)

( * ) Notice: Subject to any disclaimer, the term of this patent is extended or adjusted under 35 U.S.C. 154(b) by 188 days.

(21) Appl. No.: 13/827,377

(22) Filed: Mar. 14, 2013

(65) Prior Publication Data

US 2013/0270773 A1 Oct. 17, 2013

Related U.S. Application Data

(60) Provisional application No. 61/614,735, filed on Mar. 23, 2012.

(51) Int. Cl.
*F41J 5/24* (2006.01)

(52) U.S. Cl.
CPC ..... *F41J 5/24* (2013.01); *Y10T 156/1052* (2015.01)

(58) Field of Classification Search
CPC ..... F41J 1/01; F41J 5/00; F41J 5/24
USPC ..... 273/378, 403–410
See application file for complete search history.

(56) References Cited

U.S. PATENT DOCUMENTS

| | | | | |
|---|---|---|---|---|
| 1,145,585 | A | | 7/1915 | Hebard et al. |
| 1,175,692 | A | | 3/1916 | Boicourt et al. |
| 3,330,561 | A | | 7/1967 | Kandel |
| 3,353,827 | A | | 11/1967 | Dun, Jr. |
| 3,370,852 | A | | 2/1968 | Kandel |
| 3,423,092 | A | | 1/1969 | Kandel |
| 3,895,803 | A | | 7/1975 | Loe |
| 3,899,175 | A | | 8/1975 | Loe |
| 4,462,598 | A | | 7/1984 | Chalin et al. |
| 4,921,256 | A | * | 5/1990 | Gearhart ..... 273/378 |
| 5,186,468 | A | | 2/1993 | Davies |
| 5,188,371 | A | | 2/1993 | Edwards |
| 5,275,890 | A | * | 1/1994 | Wolf et al. ..... 428/514 |
| 5,437,931 | A | | 8/1995 | Tsai et al. |
| 5,501,467 | A | | 3/1996 | Kandel |
| 5,580,063 | A | | 12/1996 | Edwards |

(Continued)

*Primary Examiner* — Mark Graham
(74) *Attorney, Agent, or Firm* — Pauly, DeVries, Smith & Deffner, L.L.C.

(57) ABSTRACT

Embodiments of the invention include printed shooting targets having reactive zones and methods related to the same. In an embodiment, the invention includes a shooting target comprising a substrate. In some embodiments, a first ink layer can be disposed on the substrate. An adhesion modifying layer disposed over the substrate and/or on the first ink layer. The adhesion modifying layer can cover less than the entire surface area of the substrate and/or first ink layer. A second ink layer disposed on the adhesion modifying layer. In an embodiment, a method of making a shooting target comprising applying discrete segments of a material over a substrate to form an adhesion modifying layer, wherein the adhesion modifying layer covers less than the entire surface area of the substrate; and applying a second ink layer over the adhesion modifying layer. Other embodiments are also included herein.

6 Claims, 11 Drawing Sheets

(56) References Cited

U.S. PATENT DOCUMENTS

| | | | | |
|---|---|---|---|---|
| 5,676,401 | A | 10/1997 | Witkowski et al. | |
| 6,019,375 | A | 2/2000 | West | |
| 6,845,982 | B2 * | 1/2005 | Kirk et al. | 273/349 |
| 7,631,877 | B2 | 12/2009 | Zara | |
| 8,444,056 | B2 | 5/2013 | Gamez et al. | |
| 8,556,268 | B2 * | 10/2013 | Su | 273/380 |
| 8,596,643 | B1 * | 12/2013 | Edwards | 273/378 |
| 2004/0036221 | A1 | 2/2004 | Martinez | |
| 2007/0046760 | A1 | 3/2007 | Zara | |
| 2013/0038020 | A1 * | 2/2013 | Davis, Jr. | 273/378 |

* cited by examiner

SHOOTING TARGET WITH REACTIVE ZONES

This application claims the benefit of U.S. Provisional Application No. 61/614,735, filed Mar. 23, 2013, the content of which is herein incorporated by reference in its entirety.

FIELD OF THE INVENTION

The present invention relates to printed shooting targets. More specifically, the present invention relates to printed shooting targets having reactive zones and methods related to the same.

BACKGROUND OF THE INVENTION

Targets for firearms are well known in the prior art. Traditional targets for firearms have various issues which limit their value to a shooter including the fact that projectile holes ("bullet holes") in the target can be difficult to see, particularly from where the shooter is positioned when firing the gun which can often times be 25 yards, 50 yards, 100 yards or farther away from the target. More recently, targets have been developed that result in the formation of a contrasting halo around the bullet hole in order to increase the visibility of the bullet hole.

SUMMARY OF THE INVENTION

Embodiments of the invention include printed shooting targets having reactive zones and methods related to the same. In an embodiment, the invention includes a shooting target comprising a substrate, a first ink layer disposed on the substrate, an adhesion modifying layer disposed on the first ink layer, wherein the adhesion modifying layer covers less than the entire surface area of the first ink layer, and a second ink layer disposed on the adhesion modifying layer. In an embodiment, a method of making a shooting target comprising applying discrete segments of a material to a first ink layer disposed on a substrate to form an adhesion modifying layer, wherein the adhesion modifying layer covers less than the entire surface area of the first ink layer; and applying a second ink layer over the adhesion modifying layer and the first ink layer.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope of the present invention is defined by the appended claims and their legal equivalents.

BRIEF DESCRIPTION OF THE FIGURES

The invention may be more completely understood in connection with the following drawings, in which.

While the invention is susceptible to various modifications and alternative forms, specifics thereof have been shown by way of example and drawings, and will be described in detail. It should be understood, however, that the invention is not limited to the particular embodiments described. On the contrary, the intention is to cover modifications, equivalents, and alternatives falling within the spirit and scope of the invention.

DETAILED DESCRIPTION OF THE INVENTION

As described above, targets have been developed that result in the formation of a contrasting halo around the bullet hole in order to increase the visibility of the bullet hole. Such targets are sometimes referred to as "reactive targets". Embodiments of the invention herein include reactive targets with additional functionality. Specifically, embodiments of the invention herein include reactive targets that include a plurality of reactive zones. In an embodiment, the invention includes a shooting target comprising a substrate, a first ink layer disposed on the substrate, an adhesion modifying layer disposed on the first ink layer, wherein the adhesion modifying layer covers less than the entire surface area of the first ink layer, and a second ink layer disposed on the adhesion modifying layer. In some embodiments, the first ink layer can be omitted and an adhesion modifying layer can be disposed directly on the substrate, the adhesion modifying layer covering less than the entire surface area of the substrate, and a second ink layer disposed on the adhesion modifying layer. Various aspects of embodiments herein will now be described in greater detail.

Figure 1:
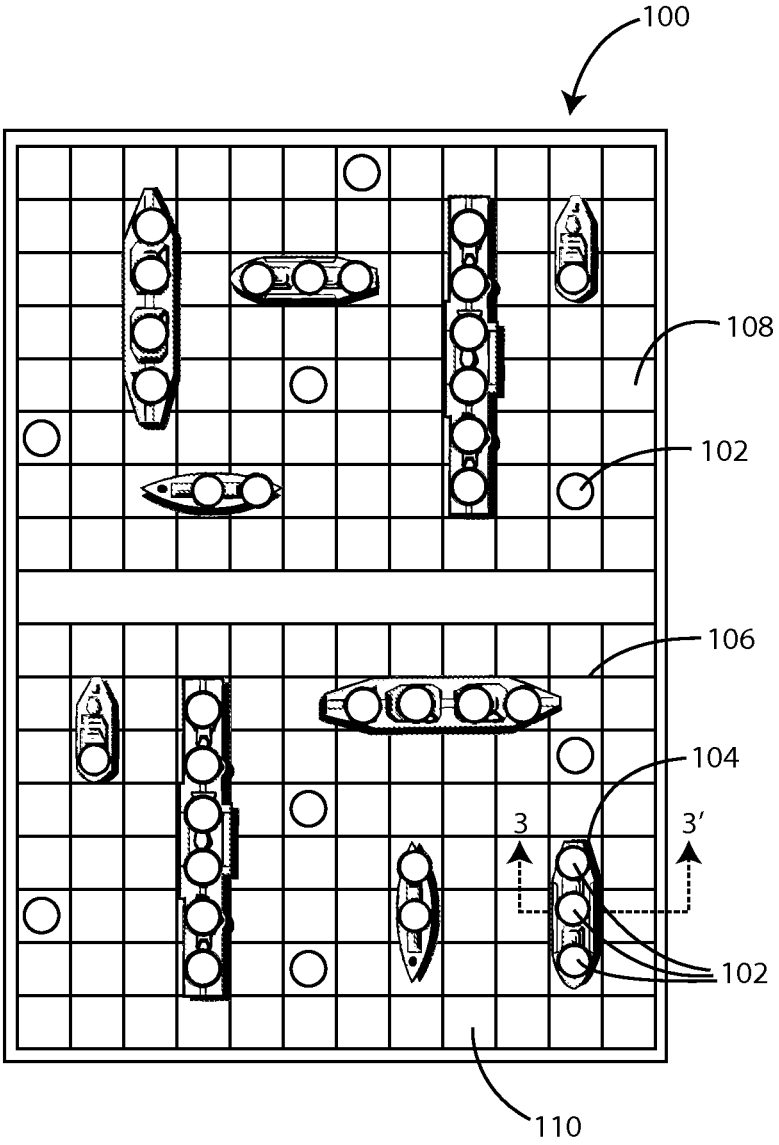
FIG. 1 is a schematic top plan view of a printed target in accordance with various embodiments herein.

Referring now to FIG. 1, a schematic top plan view of a target 100 is shown in accordance with various embodiments herein. The target 100 includes an ink layer 108 which shows visible target features including target objects 104 and a grid 106. The target 100 also includes a plurality of reactive zones 102 (it will be appreciated that there are other reactive zones generally illustrated as circles in FIG. 1, but for clarity of illustration only a representative number have been marked with identifier 102), some of which may be associated with target features and some of which may not. The area 110 of the target 100 excluding the reactive zones forms a non-reactive zone. In some embodiments, there may be a plurality of discrete non-reactive zones and in other embodiments there can be a single non-reactive zone.

In use, when a projectile such as a bullet strikes the target 100 it will produce a hole with a high visibility circle or halo around the hole if a reactive zone 102 is hit, but will simply produce a hole without any substantial high visibility halo if a non-reactive zone 110 is hit. This effect is illustrated further below such as with respect to FIGS. 4 and 5.

Figure 2:
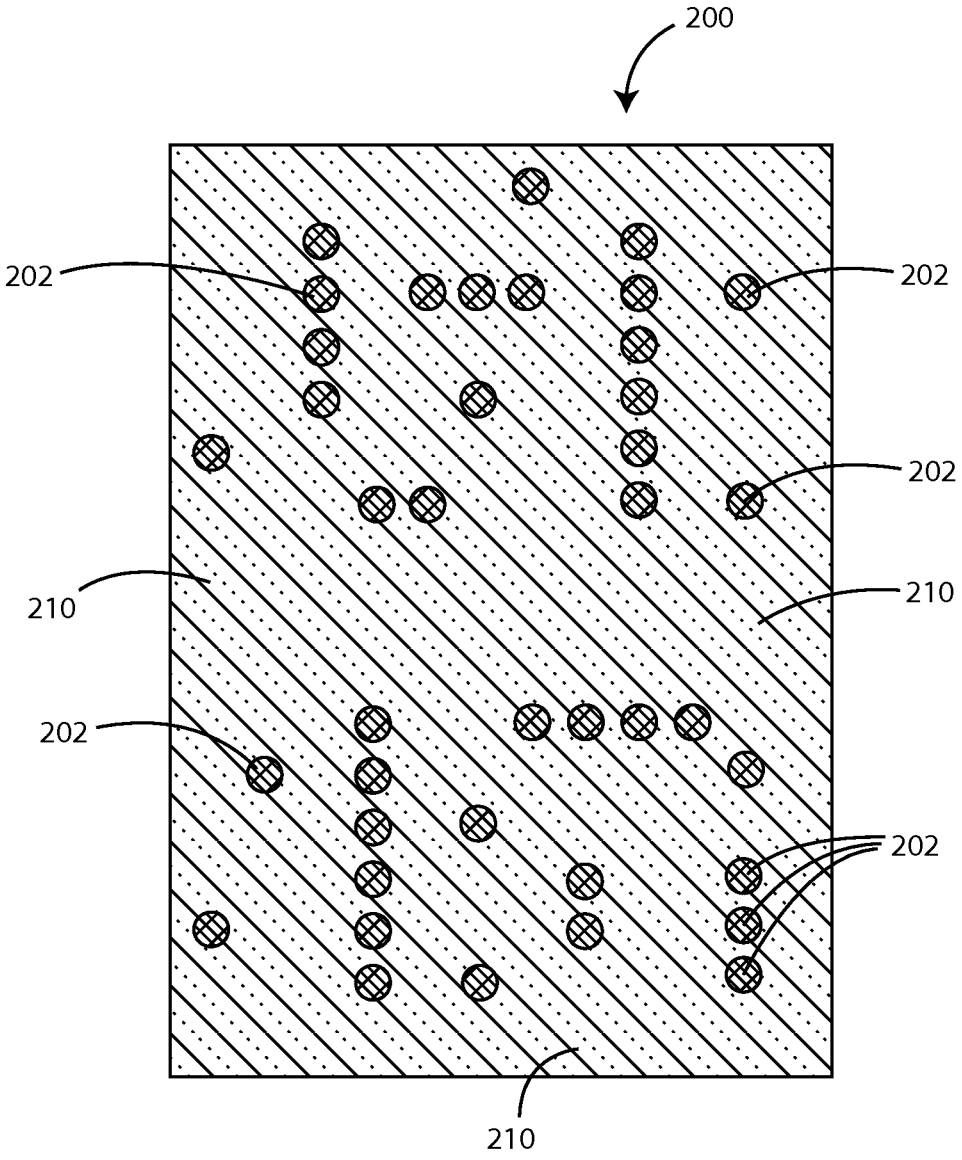
FIG. 2 is a schematic top plan view of a printed target illustrating reactive zones in accordance with various embodiments herein.

Referring now to FIG. 2, a schematic top plan view of a printed target 200 illustrating reactive zones and non-reactive zones in accordance with various embodiments herein is shown. The reactive zones 202 (it will be appreciated that there are other reactive zones generally illustrated as circles in FIG. 2, but for clarity of illustration only a representative number have been marked with identifier 202) are present on the target 200 as a plurality of discrete areas. The non-reactive zones 210 in this illustration separate reactive zones 202 from one another. It will be appreciated that while the reactive zones 202 shown in FIG. 2 are in the form of small circles that many other forms for the reactive zones 202 are possible. By way of example, the reactive zones can be in the forms of squares, ovals, polygons with various numbers of sides, as well as all types of irregular shapes.

In addition, the size of the reactive zones can vary. In some embodiments, the reactive zones are formed to approximate the size of a single bullet hole along with a desirably sized halo around the bullet hole. By way of example, in some embodiments, the reactive zones can be from about 5 millimeters to about 25 millimeters. In some embodiments, the reactive zones can be from about 10 millimeters to about 18 millimeters. In other embodiments, the reactive zones can be large enough to accommodate generating halos for a number of bullet holes. For example the reactive zones can take up a larger segment of the entire target.

Figure 3:
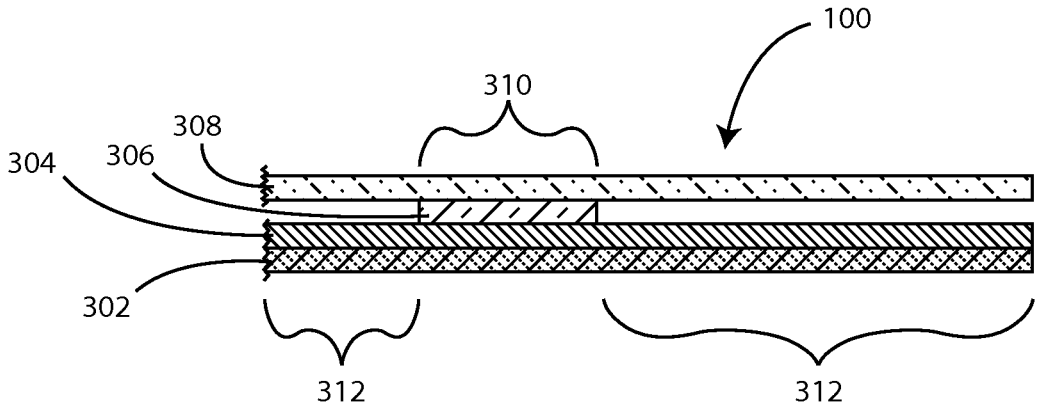
FIG. 3 is a schematic cross-sectional view of a portion of a printed target as taken along line 3-3' of FIG. 1.

Referring now to FIG. 3, a schematic cross-sectional view of a portion of a printed target 100 as taken along line 3-3' of FIG. 1 is shown. The target 100 can include a substrate 302. The substrate can include various materials. In some embodiments, the substrate can be a cellulosic material, such as paper in various weights. For example, in some embodiments, the substrate can be paper having a weight of between 16 and 140 pounds basis weight. In some embodiments, the substrate can be paper having a grammage of between 60 and 500 g/m$^2$. In some embodiments, the substrate can include non-cellulosic materials. By way of example, in some embodiments, the substrate can include polymeric materials, metal foils, laminates of different materials, and the like.

A first ink layer 304 can be disposed on the substrate 302. The first ink layer 304 can include various inks of various colors. In some embodiments, the first ink layer 304 can include between two and twenty different colors arranged in different segments across the first ink layer 304 arranged contiguously to one another or separated from one another by areas without ink in the first ink layer 304. It will be appreciated that many different types of inks can be used for the first ink layer. By way of example, inks can include water based inks, solvent based inks, flexographic inks, UV-curable inks, web offset non-heatset inks, web offset heatset inks, quickset inks, sheet-fed inks, rubber-base inks, soybean-base inks, laser inks, various types of specialty inks (including but not limited to metallic inks, luminous inks, fluorescent inks, reflective inks, glow-in-the-dark inks), and the like. In some embodiments, four-color process inks can be used for the second ink layer. In other embodiments, spot color inks can be used for the second ink layer. The amount of ink applied can depend on various factors including the color intensity of the ink as well as the colors of inks that may be underneath. In some embodiments, the amount of ink applied can be sufficient to create a visibly consistent color. In some embodiments, the amount of ink applied can be sufficient to create a visibly consistent color as viewed by the naked eye at a distance of greater than three feet. The amount of ink applied can be varied by a printing press operator to achieve a visibly consistent color. Application of the ink forming the first ink layer onto the substrate can be carried out in various ways. For example, printing techniques such as flexographic printing, offset printing, gravure printing, and the like can be used. It will be appreciated that in some embodiments the first ink layer can be at least partially within the substrate itself, such as in the case of a dye used to color a paper substrate and as such the term "disposed on" with respect to the first ink layer and the substrate shall include the circumstance wherein the first ink layer is at least partially within the substrate.

In some embodiments, the first ink layer 304 can cover the entire surface of the substrate 302. In other embodiments, the first ink layer 304 covers less than the entire surface of the substrate 302. In some embodiments, the first ink layer 304 covers a plurality of discrete segments of the first ink layer 304.

In various embodiments, an adhesion modifying layer 306 can be disposed on the first ink layer 304. The adhesion modifying layer 306 can be substantially transparent. The adhesion modifying layer 306 can cover less than the entire surface area of the first ink layer 304. The target 300 can have a reactive zone 310 in the area wherein the adhesion modifying layer 306 is present and a non-reactive zone(s) 312 in the area where the adhesion modifying layer 306 is not present. In this schematic view, in the non-reactive zone(s) 312, the first ink layer 304 and the second ink layer 308 are shown separated from one another by an empty space. It will be appreciated that this is just shown for clarity of illustration and in actuality where the adhesion modifying layer 306 is not present there is not empty space created within the target in cross-section (see, e.g., FIG. 4).

The adhesion modifying layer 306 can include various materials and can serve to form a reactive zone where it is present by modifying the behavior of ink that is deposited onto the adhesion modifying layer. In some embodiments, the adhesion modifying layer 306 can include a layer of a polymeric material. By way of example, the adhesion modifying layer 306 can include a layer of a polymer, such as polypropylene. In some embodiments, the adhesion modifying layer 306 can include a layer of biaxially oriented polypropylene (BOPP). In some embodiments, the surface of the polymer can be treated in order to modify its surface energy. By way of example, in some embodiments, the surface of the polymer can be subjected to corona discharge treatment in order to modify the surface energy of the polymer.

In some embodiments, the adhesion modifying layer 306 can include a layer of a release modifying agent. In some embodiments, the adhesion modifying layer 306 can include a layer of a release varnish. The release varnish can be aqueous, solvent-based, UV-curable, electron beam curable, or the like. In some embodiments, the release varnish can include silicone compounds. In some embodiments, the release varnish can cover the entire adhesion modifying layer 306. In other embodiments, the release varnish can cover less than the entire adhesion modifying layer 306. For example, the release varnish can cover an area less than the entire area of the polymeric material. While not intending to be bound by theory, it is believed that release properties of an ink layer on a polymeric material layer by itself will differ from release properties of an ink layer on a release varnish that is in turn on a polymeric material layer. As such, by having zones wherein the release varnish covers the polymeric material layer and zones wherein the release varnish does not cover the polymeric material layer, along with an ink layer on top of both of these types of areas, two different types of reactive zone areas can be created within the same target.

It will be appreciated that in some embodiments, the adhesion modifying layer 306 can be disposed directly on the substrate 302. For example, portions of the first ink layer 304 can be omitted or the entire first ink layer 304 can be omitted. In such embodiments, either portions of the adhesion modifying layer 306, or the entire adhesion modifying layer 306 can be disposed directly on the substrate.

In various embodiments, the target 100 can further include a second ink layer disposed on the adhesion modifying layer. The second ink layer can include various inks of various colors. In some embodiments, the second ink layer 308 can include between two and twenty different colors arranged in different segments across the second ink layer 308 arranged contiguously to one another or separated from one another by areas without ink in the second ink layer 308. It will be appreciated that many different types of inks can be used for the second ink layer 308. By way of example, inks can include water based inks, solvent based inks, flexographic inks, UV-curable inks, web offset non-heatset inks, web offset heatset inks, quickset inks, sheet-fed inks, rubber-base inks, soybean-base inks, laser inks, various types of specialty inks (including but not limited to metallic inks, luminous inks, fluorescent inks, reflective inks, glow-in-the-dark inks), and the like. In some embodiments, four-color process inks can be used for the second ink layer. In other embodiments, spot color inks can be used for the second ink layer. The amount of ink applied can depend on various factors including the color intensity of the ink as well as the colors of inks that may be underneath. In some embodiments, the amount of ink applied can be sufficient to create a visibly consistent color. In some embodiments, the amount of ink applied can be sufficient to create a visibly consistent color as viewed by the naked eye at a distance of greater than three feet. The amount of ink applied can be varied by a printing press operator to achieve a visibly consistent color. Application of the ink forming the second ink layer onto the substrate can be carried out in various ways. For example, printing techniques such as flexographic printing, offset printing, gravure printing, and the like can be used.

Figure 4:
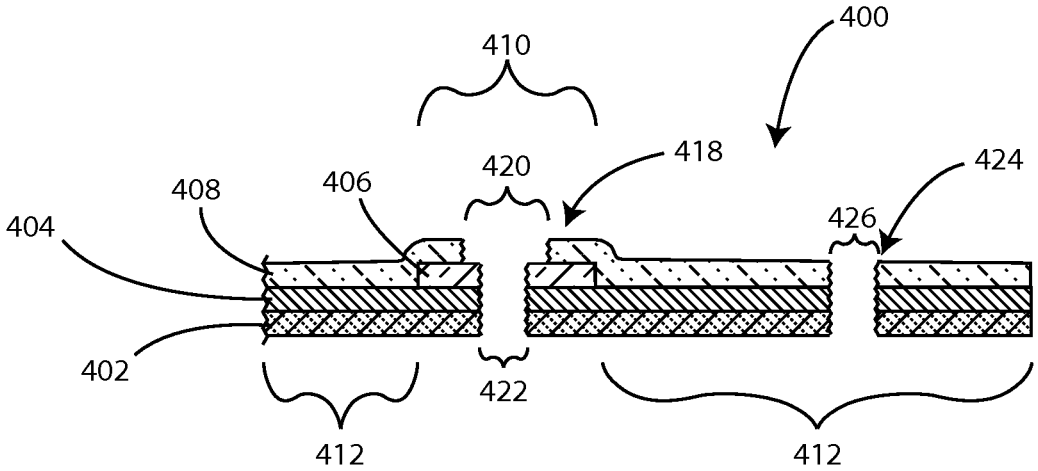
FIG. 4 is a schematic cross-sectional view of a portion of a printed target in accordance with various embodiments herein.

Referring now to FIG. 4, a schematic cross-sectional view of a portion of a printed target 400 is shown in accordance with various embodiments herein. The target 400 includes a substrate 402, a first ink layer 404 disposed on the substrate, an adhesion modifying layer 406 disposed on the first ink layer 404, and a second ink layer 408 disposed on the adhesion modifying layer 406. The target 400 includes a reactive zone 410 and non-reactive zone(s) 412. In this illustration, a first bullet hole 418 is shown within the reactive zone 410 and a second bullet hole 424 is shown in the non-reactive zone 412. The first bullet hole 418 includes an area where the second ink layer 408 is removed having a first diameter 420. The first bullet hole 418 also includes an area where the adhesion modifying layer 406 (transparent), first ink layer 404, and the substrate 402 are removed having a second diameter 422. For the first bullet hole 418, the first diameter 420 is larger than the second diameter 422. Thus, a portion of the first ink layer 404 is visible to the outside through the larger first diameter 420. For example, a portion of the first ink layer that is equal to the surface area of the first diameter 420 minus the second diameter 422 is visible to the outside creating the effect of a high visibility halo around the bullet hole 418. The second bullet hole 424 includes an area where the second ink layer 408, the first ink layer 404, and the substrate 402 are all removed and where each portion that is removed has substantially the same diameter 426.

Figure 5:
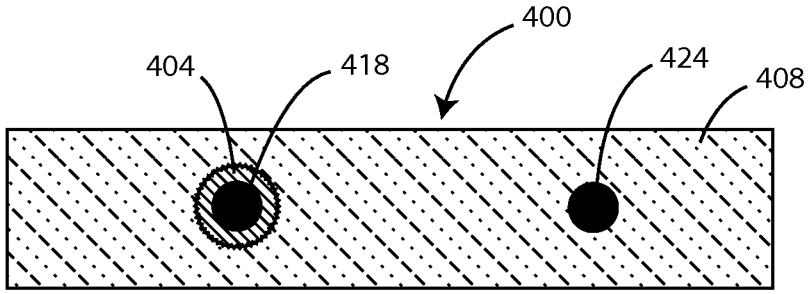
FIG. 5 is a schematic top plan view of the portion of a printed target shown in FIG. 4.

FIG. 5 is a schematic top plan view of the portion of a printed target 400 shown in FIG. 4. FIG. 5 shows the portion of the first ink layer 404 that is visible to the outside and forms the halo for the bullet hole 418 in the reactive zone in contrast to the bullet hole 424 in the non-reactive zone.

Figure 6:
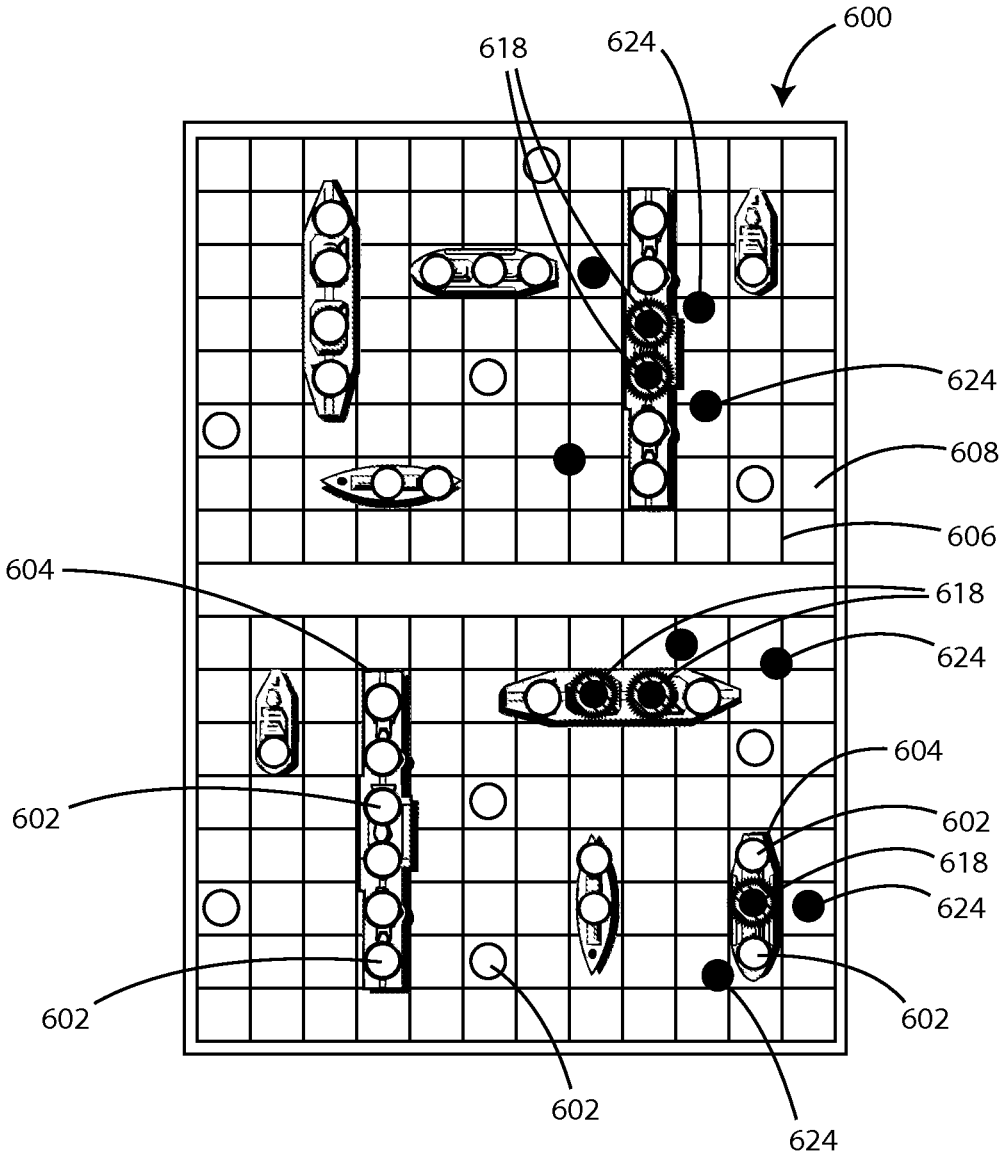
FIG. 6 is a schematic top plan view of a printed target in accordance with various embodiments herein.

Referring now to FIG. 6, a schematic top plan view of a target 600 is shown in accordance with various embodiments herein. The target 600 includes an ink layer 608 which shows visible target features including target objects 604 and a grid 606. The target 600 also includes a plurality of reactive zones 602 (it will be appreciated that there are other reactive zones generally illustrated as circles in FIG. 1, but for clarity of illustration only a representative number have been marked with identifier 602), some of which may be associated with target features and some of which may not. The area of the target 600 excluding the reactive zones forms a non-reactive zone. In this view a number of bullet holes 618 in reactive zones can be seen along with a number of bullet holes 624 in non-reactive zones. The reactive zones 602 can be associated with specific target objects 604. In some embodiments, the reactive zones 602 can be unassociated with visible target objects 604. Where the reactive zones 602 are unassociated with visible target objects 604, the reactive zones 602 can be hidden from a target user.

Figure 7:
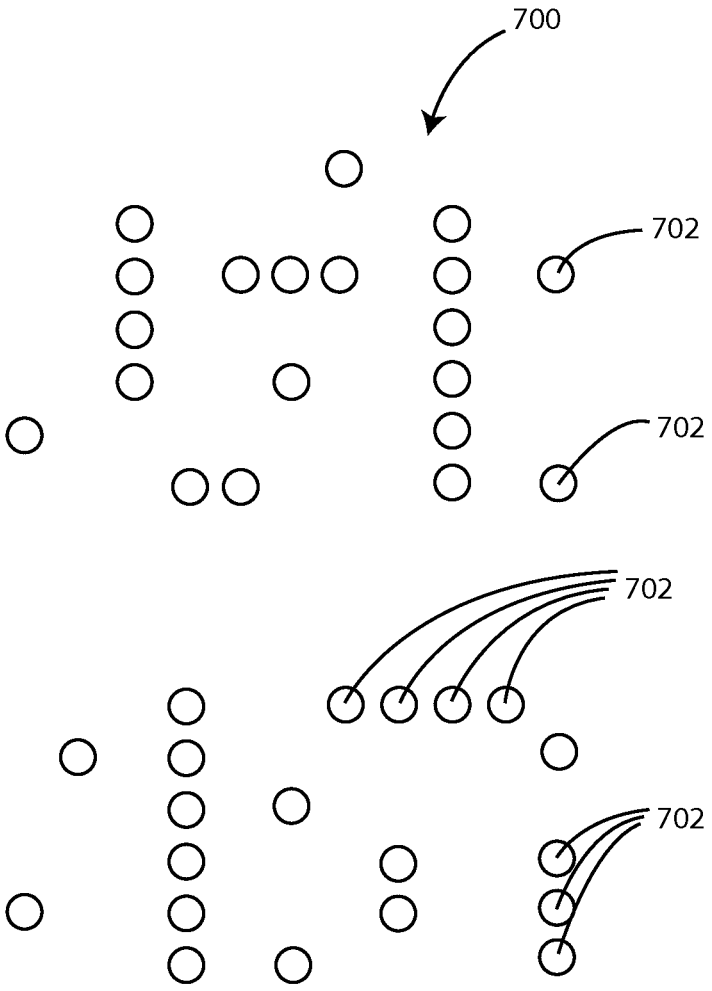
FIG. 7 is a schematic top plan view of an adhesion modifying layer in accordance with various embodiments herein.

FIG. 7 is a schematic top plan view of an adhesion modifying layer 700 of a target in accordance with various embodiments herein. In this illustration, the adhesion modifying layer 700 includes a plurality of discrete portions 702 (it will be appreciated that there are other discrete portions generally illustrated as circles in FIG. 7, but for clarity of illustration only a representative number have been marked with identifier 702).

Figure 8:
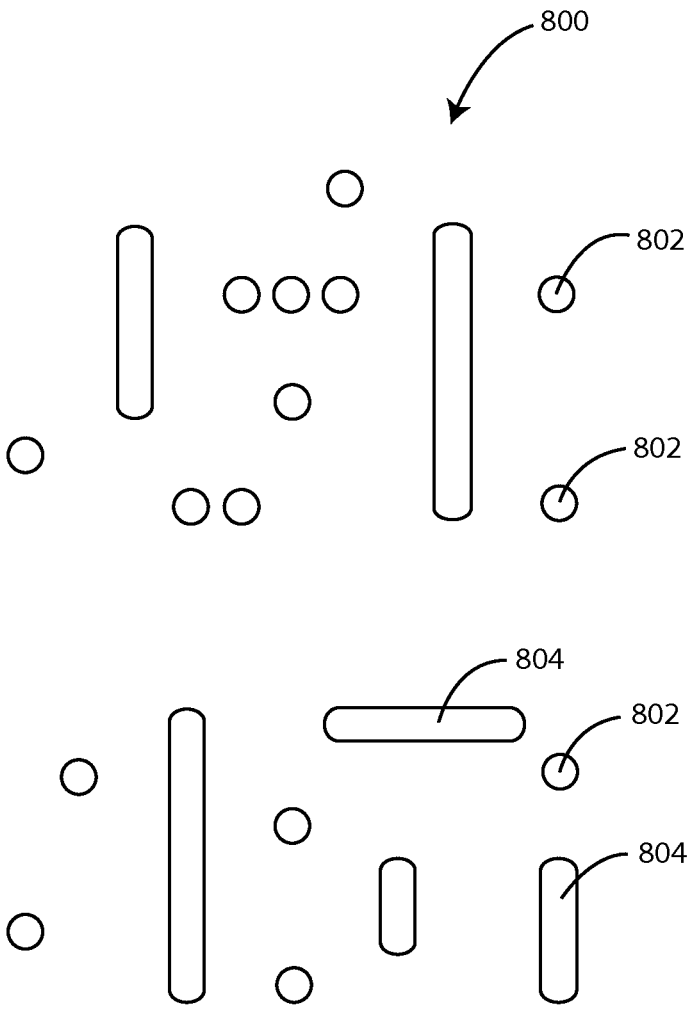
FIG. 8 is a schematic top plan view of an adhesion modifying layer in accordance with various embodiments herein.

FIG. 8 is a schematic top plan view of an adhesion modifying layer 800 in accordance with various embodiments herein. In this illustration, the adhesion modifying layer 800 includes a plurality of discrete portions 802 that are sized to roughly correspond to individual bullet holes and a plurality of discrete portions 804 that are sized to correspond to multiple bullet holes and/or specific target features that can be present in the second ink layer (such as 104 in FIG. 1).

Figure 9:
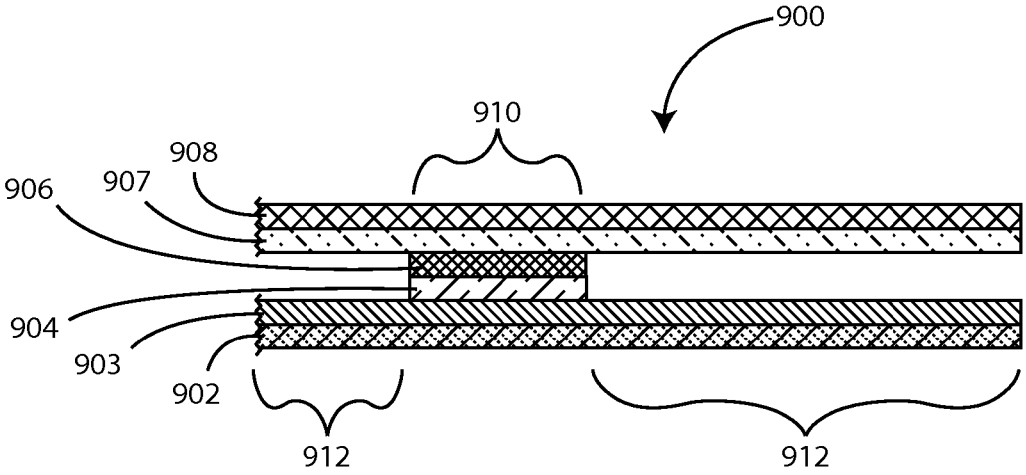
FIG. 9 is a schematic cross-sectional view of a portion of a printed target in accordance with various embodiments herein.

FIG. 9 is a schematic cross-sectional view of a portion of a printed target in accordance with various embodiments herein. The target 900 includes a substrate 902, a first ink layer 903 disposed on the substrate, a polymeric layer 904 disposed on the first ink layer 903, a release varnish layer 906 disposed on the polymeric layer 904, a second ink layer 907 disposed on the release varnish layer 906, and a protective varnish layer 908 disposed on the second ink layer 907. The polymeric layer 904 and the release varnish layer 906 can together make up an adhesion modifying layer. In some embodiments, the polymeric layer 904 and the release varnish layer 906 can be coterminous in their surface area coverage and in other embodiments be different. By way of example, in some embodiments, the polymeric layer 904 can cover more of the surface area of the target than the release varnish layer 906. In other embodiments, the release varnish layer 906 can cover more of the surface area of the target than the polymeric layer 904. The target 900 includes a reactive zone 910 and non-reactive zone(s) 912.

Figure 10:
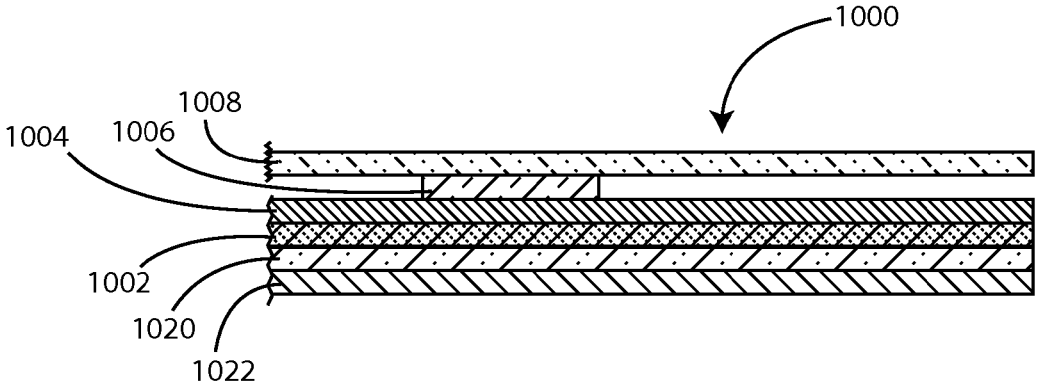
FIG. 10 is a schematic cross-sectional view of a portion of a printed target in accordance with various embodiments herein.

It will be appreciated that in some embodiments additional layers can be included and in other embodiments certain layers can be omitted. FIG. 10 is a schematic cross-sectional view of a portion of a printed target 1000 in accordance with various embodiments herein. FIG. 10 shows a target 1000 with additional layers present. The target 1000 includes a substrate 1002, a first ink layer 1004 disposed on the substrate, an adhesion modifying layer 1006 disposed on the first ink layer 1004, and a second ink layer 1008 disposed on the adhesion modifying layer 1006. Underneath the substrate 1002, a layer of adhesive 1020 is disposed. Underneath the layer of adhesive 1020 is a target base 1022. The target base 1022 can include a silicone material in order to allow the adhesive 1020 to be pulled off of the target base 1022.

Figure 11:
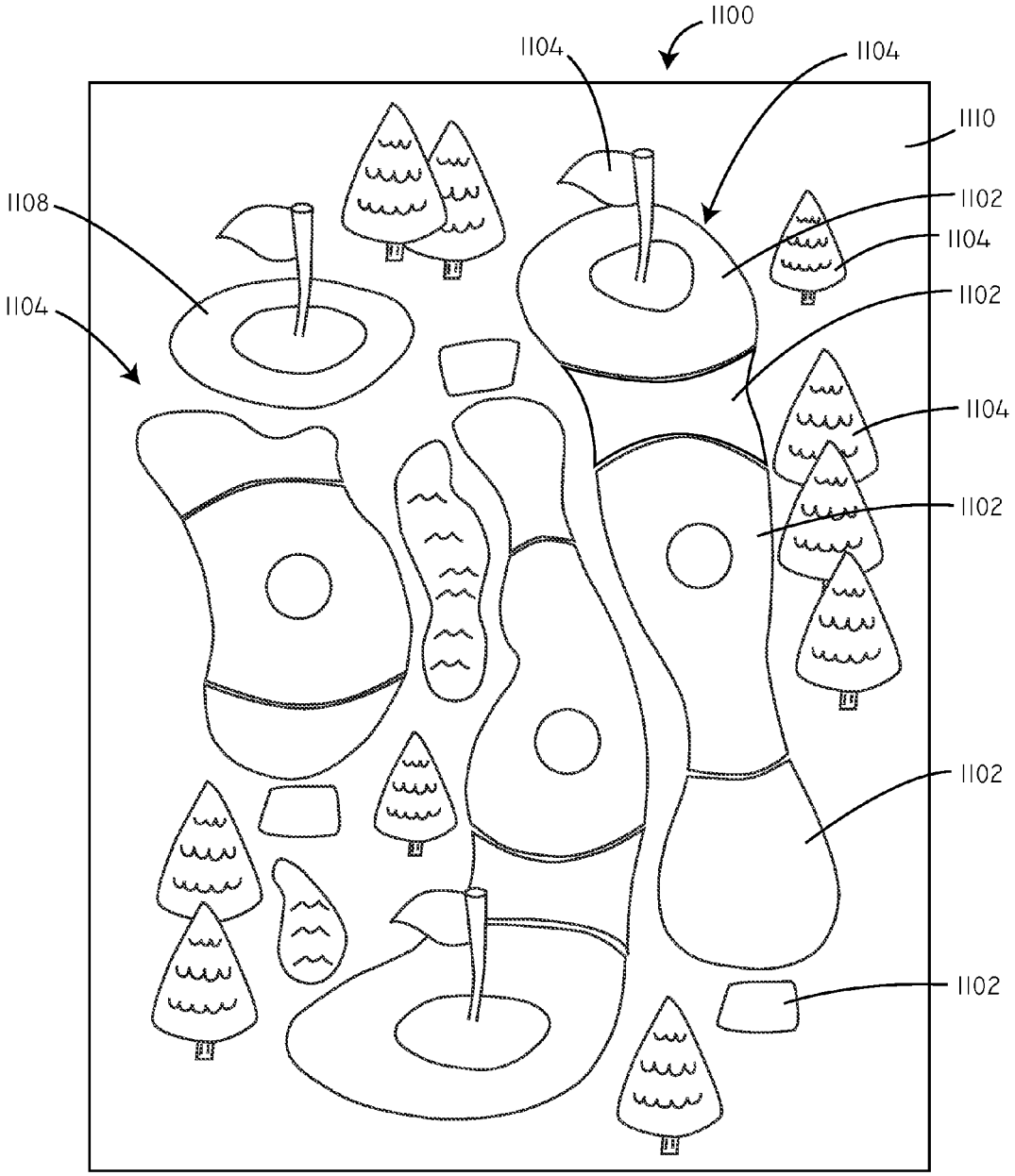
FIG. 11 is a schematic top plan view of a printed target in accordance with various embodiments herein.

It will be appreciated that shooting targets in accordance with embodiments herein can take on many different forms and physical configurations. By way of example, reactive zones and non-reactive zones can take on many different specific shapes and sizes. Referring now to FIG. 11, a schematic top plan view of a printed shooting target in accordance with another embodiment of the invention is shown. The target 1100 includes an ink layer 1108 which shows visible target features including target objects 1104. The target 1100 also includes a plurality of reactive zones 1102 (it will be appreciated that there are other reactive zones in FIG. 1, but for clarity of illustration only a representative number have been marked with identifier 1102), some of which may be associated with target features and some of which may not. The area 1110 of the target 1100 excluding the reactive zones forms a non-reactive zone. In some embodiments, there may be a plurality of discrete non-reactive zones separated from one another and in other embodiments there can be a single non-reactive zone. In use, when a projectile such as a bullet strikes the target 1100 it will produce a hole with a high visibility circle or halo around the hole if a reactive zone 1102 is hit, but will simply produce a hole without any substantial high visibility halo if a non-reactive zone 1110 is hit.

Figure 12:
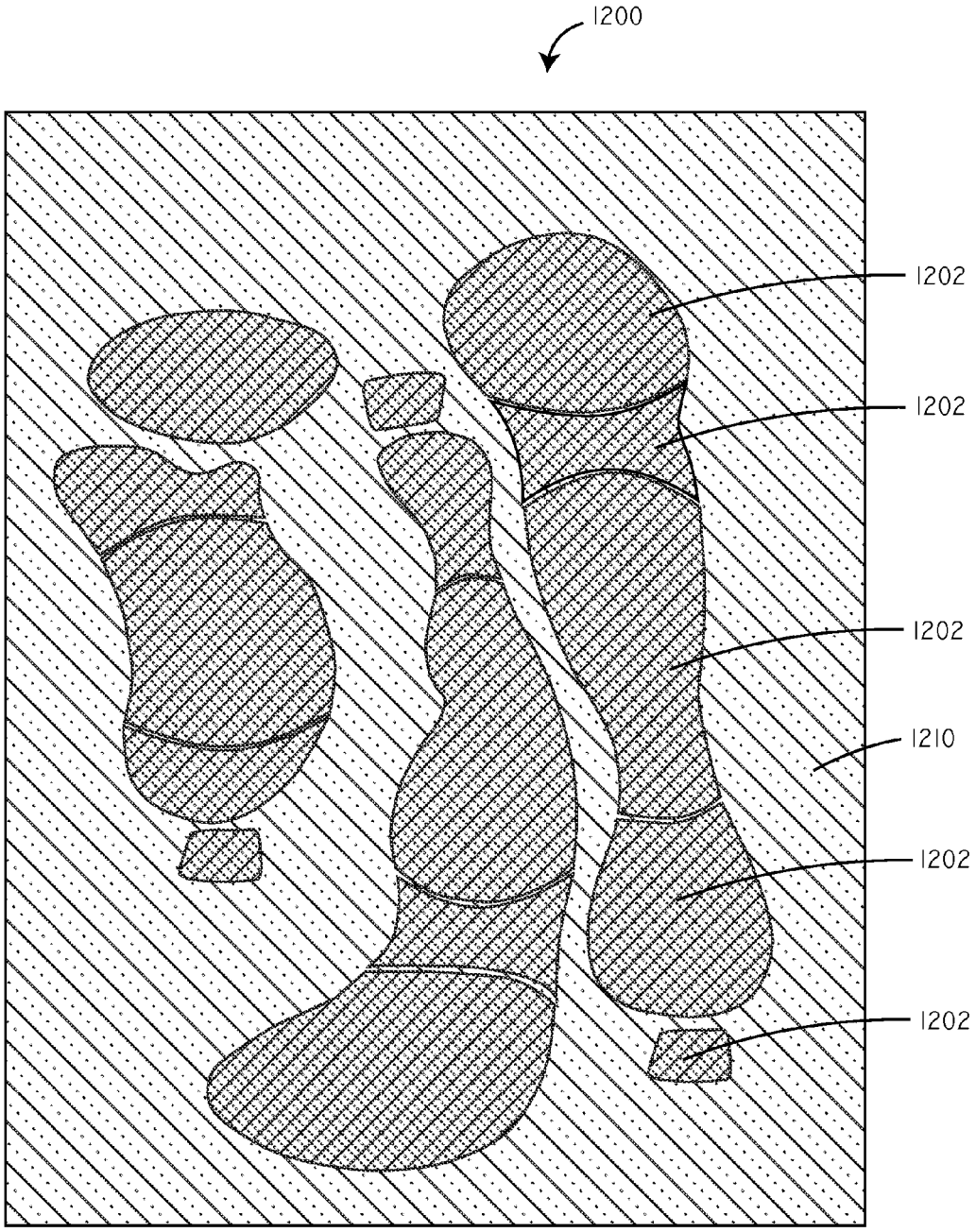
FIG. 12 is a schematic top plan view of a printed target illustrating reactive zones in accordance with various embodiments herein.

Referring now to FIG. 12, a schematic top plan view of a printed target 1200 illustrating reactive zones and non-reactive zones corresponding to the target of FIG. 11 is shown. The reactive zones 1202 (it will be appreciated that there are other reactive zones generally illustrated as circles in FIG. 12, but for clarity of illustration only a representative number have been marked with identifier 1202) are present on the target 1200 as a plurality of discrete areas. The non-reactive zones 1210 in this illustration separate reactive zones 1202 from one another.

Figure 13:
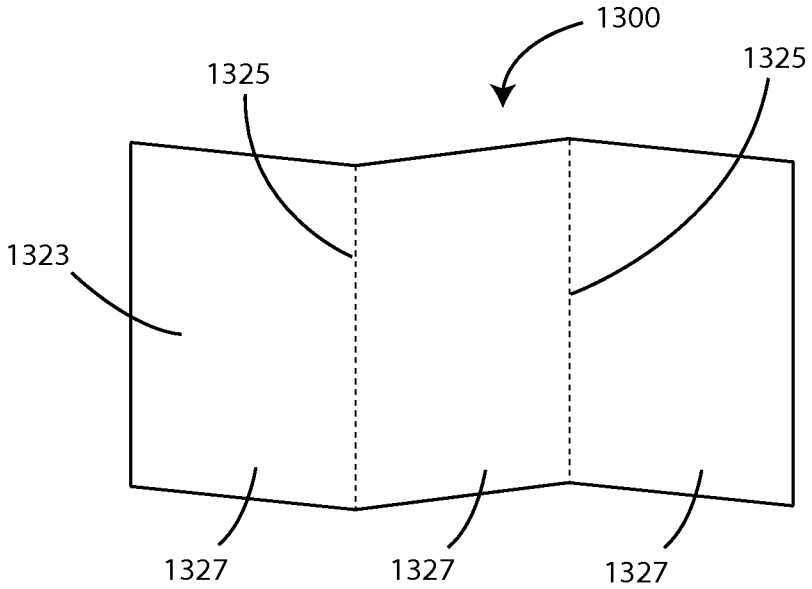
FIG. 13 is a schematic view of a backer board in accordance with various embodiments herein.

It will be appreciated that in some embodiments shooting targets can be place on backer boards. Referring now to FIG. 13, a schematic view of a backer board 1300 is shown in accordance with various embodiments herein. The backer board 1300 can be made of various materials including, but not limited to, cardboard, corrugated cardboard, other cellulosic materials, heavy sheets of plastic, corrugated plastic, or the like. For various reasons including that the overall size of the backer board 1300 may be relatively large, it can be provided with folds 1325 in order to make it more compact for shipping and/or transportation. In other words, the backer board 1300 can include panels 1327 that can be folded over one another.

Figure 14:
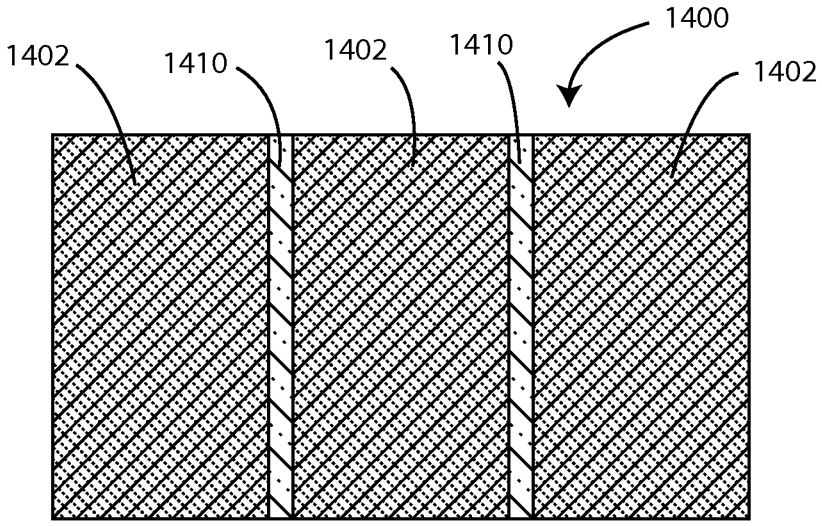
FIG. 14 is a schematic top plan view of a printed target illustrating reactive zones in accordance with various embodiments herein.

It will be appreciated that within reactive zones of targets herein, the ink that is disposed over an adhesion modifying layer may detach rather easily upon handling. In particular, if a target is attached onto a backer board, the ink over the adhesion modifying layer in the area of the folds may be subjected to repetitive bending and may ultimately detach before use. As such, in some embodiments, non-reactive zones can be positioned such that they align with areas of substantial stress or flexion (such as a fold) on a backer board or other target support. Referring now to FIG. 14, a schematic top plan view of a printed target 1400 illustrating reactive zones and non-reactive zones is shown. The non-reactive zones 1410 in this illustration separate reactive zones 1402 from one another. In particular, the non-reactive zones 1410 in this illustration are positioned such that they would line up with the folds 1325 on the backer board 1300 shown in FIG. 13. In some embodiments, the non-reactive zones 1410 can be in a shape that is substantially straight and relatively narrow and cross the entire surface of the target. In some embodiments, there can be at least one non-reactive zone, at least two non-reactive zones, at least three non-reactive zones, or more.

Included within the scope herein are methods of making targets. By way of example embodiments can include methods of making a shooting target comprising applying discrete segments of a material to a first ink layer disposed on a substrate to form an adhesion modifying layer, wherein the adhesion modifying layer covers less than the entire surface area of the first ink layer, and applying a second ink layer over the adhesion modifying layer and the first ink layer. In some embodiments, the method can further include applying a first ink layer onto the substrate.

In various methods, the discrete segments of material can be discrete segments of a polymeric layer. For example, the polymeric layer can be, for example, polypropylene, such as biaxially-oriented polypropylene (BOPP). In some embodiments, the method can further include die-cutting the polymeric layer to form the discrete segments of material. In some embodiments, die-cutting the polymeric layer to form the discrete segments of material is performed prior to applying the discrete segments of material to the substrate and/or first ink layer. In other embodiments, applying discrete segments of a material to a first ink layer disposed on a substrate to form an adhesion modifying layer includes applying a polymeric layer over the first ink layer, followed by die cutting of the polymeric layer, followed by removing and discarding segments (waste stock or scrap laminate) of the polymer layer corresponding to non-reactive zones. In some embodiments, the pattern of the die for die-cutting is configured to provide a continuous piece of waste stock that can be peeled off of the substrate and/or first ink layer in a substantially continuous operation. For example, referring to FIGS. 2 and 12, the non-reactive zones 210 and 1210 can correspond to the shape of the waste stock that is peeled off. In other embodiments, the pattern of the die for die-cutting is configured to provide a plurality of discrete pieces of waste stock.

In some embodiments, discrete pieces of a polymeric material can be placed as separate elements. For example, discrete pieces of a polymeric material can be placed individually in desired positions.

In some embodiments, the discrete segments of material can include discrete segments of a release varnish. However, in some embodiments, a release varnish can be applied over the entire surface of the target. The release varnish can be applied in various ways. In some embodiments the release varnish can be applied to discrete segments using a flexographic plate. In some embodiments, applying the first ink layer to the substrate comprises printing the first ink layer onto the substrate using a flexographic printing press. In some embodiments, applying the second ink layer over the adhesion modifying layer and the first ink layer can include applying the second ink layer using a flexographic printing press.

In some embodiments, non-reactive zones (such as those shown in various FIGS. herein) can be formed by using a component that selectively increase adhesion between a second or top ink layer and what is disposed below the second ink layer. By way of example, in some embodiments, even where an adhesion modifying layer is present, a material or surface treatment could be used in order to increase adhesion between the adhesion modifying layer (or another component or layer) and the second or top ink layer. For example, a varnish or other coating with adhesive properties could be used to selectively increase adhesion of the second ink layer with components below the second ink layer in order to create a non-reactive zone. As another example, a surface treatment applied to a material of the adhesion modifying layer, such as corona discharge treatment of a plastic film could be used to selectively increase adhesion of the second ink layer in order to create non-reactive zones. It will be appreciated that there are various ways in which adhesion can be increased. In some embodiments, an adhesion increasing material can be added on top of the second ink layer. In other embodiments, an adhesion increasing material can be added underneath the second ink layer.

It should be noted that, as used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

The invention has been described with reference to various specific and preferred embodiments and techniques. However, it should be understood that many variations and modifications may be made while remaining within the spirit and scope of the invention.

The invention claimed is:

1. A shooting target comprising:

a substrate;

a first ink layer disposed over the substrate;

an adhesion modifying layer disposed over the first ink layer; wherein the adhesion modifying layer covers less than the entire surface area of the substrate; the adhesion modifying layer comprising a polymeric material and a release varnish;

wherein the polymeric material and the release varnish are not coterminous in their surface area coverage forming at least one first reactive zone wherein the release varnish covers the polymeric material layer and at least one second reactive zone wherein the release varnish does not cover the polymeric material layer; and a second ink layer disposed over the adhesion modifying layer and covering the at least one first reactive zone and the at least one second reactive zone.

2. The shooting target of claim 1, the second ink layer comprising a plurality of first and second reactive zones and non-reactive zones.

3. The shooting target of claim 1, the second ink layer covering an area equal to the entire surface of the substrate.

4. A shooting target comprising:

a substrate;

an adhesion modifying layer disposed over the substrate; wherein the adhesion modifying layer covers less than the entire surface area of the substrate; the adhesion modifying layer comprising a polymeric material and a release varnish;

wherein the polymeric material and the release varnish are not coterminous in their surface area coverage forming at least one first reactive zone wherein the release varnish covers the polymeric material layer and at least one second reactive zone wherein the release varnish does not cover the polymeric material layer; and an ink layer disposed over the adhesion modifying layer.

5. The shooting target of claim 1, the polymeric material comprising multiple die-cut discrete portions.

6. A method of making a shooting target comprising applying discrete segments of materials over a substrate to form an adhesion modifying layer, wherein applying the discrete segments includes:

applying a polymeric layer over the substrate;

die cutting the polymeric layer;

removing segments of the polymeric layer corresponding to one or more non-reactive zones; and applying a release varnish over portions of the polymeric material;

wherein the polymeric material and the release varnish are not coterminous in their surface area coverage forming at least one first reactive zone wherein the release varnish covers the polymeric material layer and at least one second reactive zone wherein the release varnish does not cover the polymeric material layer; and applying a second ink layer over the adhesion modifying layer.

* * * * *